US006244698B1

(12) United States Patent
Chino et al.

(10) Patent No.: US 6,244,698 B1
(45) **Date of Patent: *Jun. 12, 2001**

(54) PRINTHEAD UNIT AND INK CARTRIDGE

(75) Inventors: Masahiko Chino; Kunihiko Matsuhashi; Shunji Umemura, all of Nagano (JP)

(73) Assignee: Seiko Epson Corporation, Nagano-Ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/004,796

(22) Filed: Jan. 9, 1998

(30) Foreign Application Priority Data

Jan. 9, 1997 (JP) ..... 9-013393

(51) Int. Cl.[7] ..... B41J 2/17
(52) U.S. Cl. ..... 347/94
(58) Field of Search ..... 347/85, 86, 87, 347/94, 84

(56) References Cited

U.S. PATENT DOCUMENTS

| | | | | |
|---|---|---|---|---|
| 4,112,433 | * | 9/1978 | Vernon | 347/11 |
| 4,354,197 | * | 10/1982 | Reitberger | 347/55 |
| 4,638,327 | * | 1/1987 | Sutera et al. | 347/94 |
| 5,477,963 | * | 12/1995 | Mochizuki et al. | 206/701 |
| 5,633,667 | * | 5/1997 | Miyazawa | 347/86 |
| 5,808,644 | | 9/1998 | Imamura et al. | 347/93 |

FOREIGN PATENT DOCUMENTS

| | | |
|---|---|---|
| 61-112648 | 5/1986 | (JP) . |
| 1-308645 | 12/1989 | (JP) . |
| 4-265752 | 9/1992 | (JP) . |

* cited by examiner

*Primary Examiner*—N. Le
*Assistant Examiner*—Michael Nghiem
(74) *Attorney, Agent, or Firm*—Stroock & Stroock & Lavan LLP

(57) ABSTRACT

A printhead unit is detachably coupled to an ink cartridge. The printhead unit includes an ink passage and a damper member for absorbing a pulsation of ink in the ink passage. The damper member permits the forces created when the ink cartridge receives an impact to be absorbed rather than translated through to the printhead, thereby destroying the meniscuses in the nozzles.

21 Claims, 13 Drawing Sheets

PRINTHEAD UNIT AND INK CARTRIDGE

BACKGROUND OF INVENTION

The present invention relates to an ink jet printer having an ink cartridge and more particularly to a printhead unit and ink cartridge used in an ink jet printer.

A small impact applied to an ink jet printer, for example when the printer drops from a height of about 1 to 2 cm, will destroy the meniscuses in the nozzle plane of the printhead. When the ink jet printer receives an impact, the impact propagates to the printhead unit contained in the printer which causes the ink in the ink passage to begin to pulsate. Because the ink passage is substantially closed by an ink absorbing member (or filter) of the ink cartridge, the pulsation of ink is reflected from the ink cartridge and travels to the nozzles in the printhead thereby destroying the meniscuses in the nozzles. In the ink jet printers currently marketed, the meniscuses may even be destroyed when the printer is merely moved. When the meniscuses are destroyed, a variety of problems may arise including: "nozzle missing" resulting in the improper discharge of ink and the "bending" of the shooting ink drop thus causing the printhead to become soiled from leaking ink thereby affecting performance. As a result, ink jet printer manufacturers generally include in the printer manual instructions on how to manually clean the printhead after the printer has been moved. This problem is more acute for portable ink jet printers that are frequently moved. This forces the user to frequently clean the printhead to maintain acceptable printer performance.

The continuous loss of ink and the need to clean the printhead as a result of the meniscus destruction problem will adversely affect the marketability of these printers. One partial solution may be to increase the size of the ink cartridge thus providing the user with additional ink. However, increasing the size of the ink cartridge makes it difficult to meet the market demand for reduced printer size and portability.

Accordingly, it is desirable to have a printhead unit for use in an ink jet printer in which the meniscuses of the nozzle plane are not destroyed on impact.

SUMMARY OF THE INVENTION

The present invention is directed to a printhead unit which detachably couples to an ink cartridge. An ink passage extends through the ink cartridge and printhead. A damper member for absorbing a pulsation of ink in an ink passage is disposed in facing relationship with the ink passage.

The damper member for absorbing a pulsation of the ink is disposed in the printhead facing the ink passage. With this unique feature, the ink pulsation caused by the impact to the printer is absorbed before it reaches the nozzle plane preserving the meniscus at the nozzle plane.

A preferred embodiment of the invention includes a printhead unit of the surface contact type in which the printhead unit is coupled with the ink cartridge in a surface contact fashion. A connection member of the printhead unit is coupled with an ink supplying port of the ink cartridge. A head needle is disposed on the connection member. The head needle is mounted on a printhead and the ink passage of the printhead unit includes a first ink passage in fluid communication with the ink supplying port of the ink cartridge, a second ink passage in fluid communication with the first ink passage, and a third ink passage in fluid communication with the second ink passage of the printhead.

In one embodiment, the damper member is provided in the connection member in a position that faces the first ink passage. The damper member is easily formed in the connection member which is separate from the printhead and the head needle because in a connection structure of the surface contact type, the ink passage opening is large. Forming the damper member in the connection member does not have any adverse effect on the supplying of ink, as it would if it was formed in the printhead.

In an exemplary embodiment, the printhead unit is constructed such that the damper member is provided in the circumferential wall of the connection member. The damper member is formed as a stagnate air recess in fluid communication with the first ink passage allowing air to stagnate therein. The stagnate air recess may easily be formed by boring a long and narrow indentation into the circumferential wall of the connection member extending in a direction perpendicular to the first ink passage. The indentation faces the first ink passage. The stagnate air recess may also include a through-hole passing through the circumferential wall of the connection member and extending in the direction perpendicular to the first ink passage. A sealing member seals both ends of the through-holes. The stagnate air recess may easily be formed by drilling a through-hole in the circumferential wall, the sealing member being a rubber ring.

In a preferred embodiment, the stagnate air recess includes a choke passage in fluid communication with the first ink passage so that the surface tension of the ink at the choke passage blocks the inflow of ink into the stagnate air recess, and a buffering space that is contiguous with the choke passage. The damper member constructed in such a manner communicates with the first ink passage through the choke passage and prevents the inflow and outflow of the ink to and from the buffering space.

In a preferred embodiment, the damper member includes a flexible sealing film member located in a position facing the first ink passage, and a stagnate air recess located in a position facing the first ink passage with the flexible sealing film member disposed between the first ink passage and the air stagnate recess. In this way, the flexible sealing film member reliably prevents the inflow and outflow of ink to and from the stagnate air recess.

In another exemplary embodiment, the damper member is provided in the circumferential wall of the connection member, and includes a passage extending from the first ink passage to the outside of the circumferential wall. A flexible sealing film member is disposed on the outer surface of the circumferential wall for sealing the passage opening in the outside of the circumferential wall. In this way, the first ink passage is opened to outside air through the flexible sealing film member. Accordingly, an unlimited amount of force resulting from the pulsation of ink can be absorbed in a reliable manner.

The sealing film member may be replaced by a combination of a sealing cap provided at the opening of the outer end of the passage, and an urging means for urging the sealing cap in the sealing direction.

The damper member may be a flexible film member being filled with a gas, for example air, and located in the first ink passage. To form the damper member for absorbing the ink pulsation, the film member is put in the first ink passage without requiring any modifications to the connection member. The film member is bonded onto the inner wall of the first ink passage so that it remains stationary.

The film member may be replaced by a flexible foam member. In this case, the plurality of pores included in the foam member absorb the pulsation of ink.

The damper member may be placed in the head needle in a location facing the second ink passage. In this case, the damper member may easily be formed in the major part (tubular part) or the expanded part (ink reservoir) of the head needle. Placing the damper member in the head needle does not have any adverse effect on the ink passage as in the case of placing the damper member in the connection member.

In another embodiment, the printhead unit of the needle connection type is coupled with the ink cartridge in a needle contact type. A head needle is coupled with an ink supplying port of the ink cartridge. The head needle is mounted on the printhead. A passage includes a fourth ink passage formed in the head needle and coupled with the ink supplying port. A fifth ink passage is formed in the printhead and communicates with the fourth ink passage. In this case, the damper member is preferably provided in the head needle so as to not adversely affect the supplying of ink.

Under the present invention, an ink jet printer is provided with any of the printhead units previously defined. An ink jet printer thus constructed has a good impact resistance performance and therefore can be made portable or otherwise frequently moved.

Further, under the present invention there is provided an ink cartridge for use in an ink jet printer, the ink cartridge being selectively attachable to a printhead unit contained in the printer body of the ink jet printer, the ink cartridge having a member positioned facing an ink reservoir of an ink supplying port for absorbing the pulsation of ink. In this construction, because the damper member is positioned facing an ink reservoir of an ink supplying port, the ink pulsation can be absorbed without having to alter the structure of the printer body. This enables any conventional ink jet printer to include the pulsation absorbing function.

In a preferred embodiment, the damper member is provided in the circumferential wall of the ink supplying port.

In a preferred embodiment, the ink cartridge is constructed such that a sealing member is provided in the ink supplying port, the sealing member sealing the ink reservoir and a head needle of the printhead being thrust into the sealing member, and the damper member being provided in the sealing ember. In this way, the damper member may be provided more easily than if it is formed in the circumferential wall of the ink supporting port.

In a preferred embodiment, the damper member is a sealing member formed with a flexible foam member. In this case, the damper member may be provided in a simple and easy manner and at a low cost.

In a preferred embodiment, the damper member is a flexible film member being filled with a gas, for example air, and located in the ink reservoir or a flexible, foam member located in the ink reservoir.

Accordingly, it is an object of this invention to provide a printhead unit and ink cartridge in which the meniscuses in the nozzle plane are not destroyed on impact.

Another object of the invention is to provide an impact resistant ink cartridge for use in conventional ink jet printers.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2(*a*) is an enlarged sectional view of an ink supply port of the needle type connection;

FIG. 2(*b*) is an enlarged sectional view of an ink supply needle;

FIG. 5(*a*) is an enlarged view of the damper member of FIG. 5 constructed in accordance with the invention;

FIG. 10(*a*) is an enlarged view of the damper member of FIG. 10;

FIG. 15(*a*) is an enlarged sectional view of the damper member of FIG. 15;

DETAILED DESCRIPTION OF THE PREFERRED EMBODIMENTS

Figure 1:
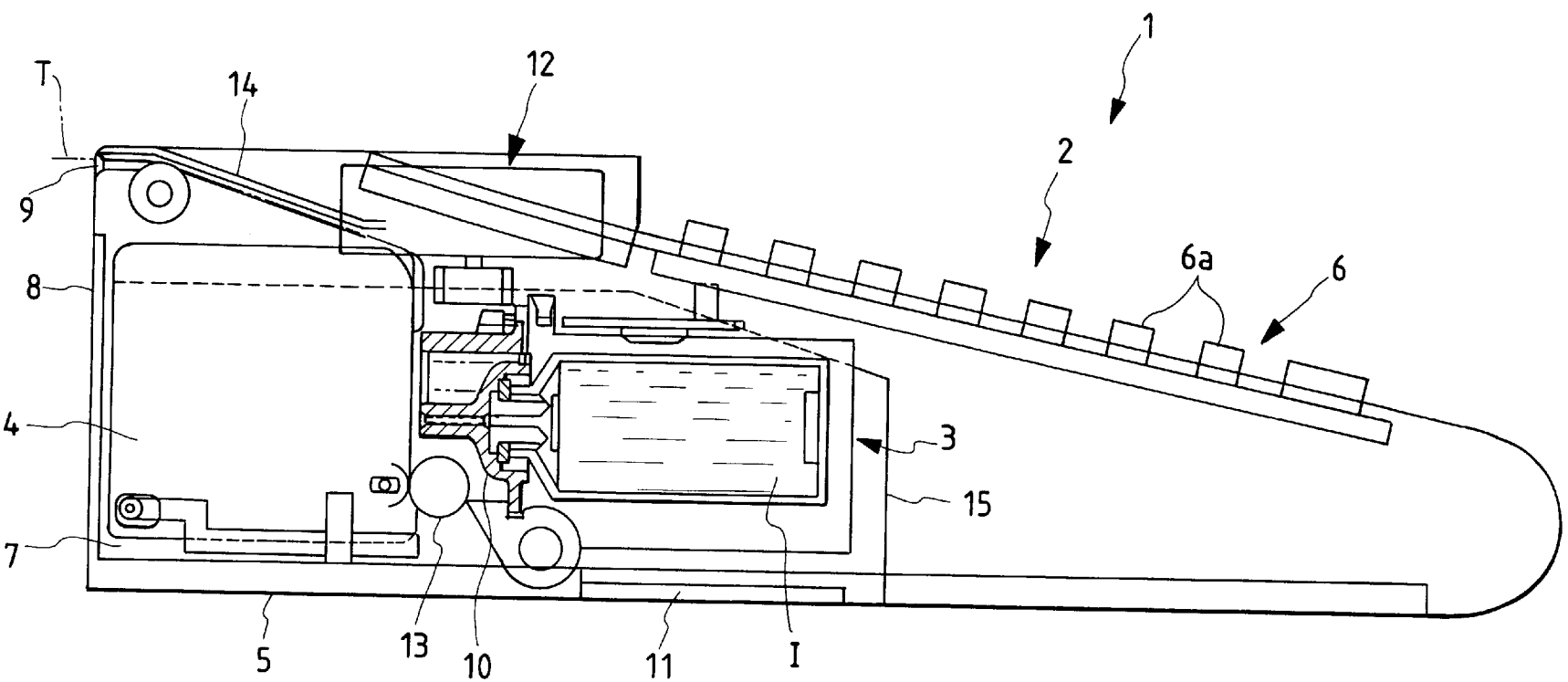
FIG. 1 is a cross sectional view of a tape printing device incorporating a printhead unit and an ink cartridge constructed in accordance with the present invention.

Referring now to FIG. 1, there is shown a cross sectional view of a tape printing device, generally indicated as 1. As shown, tape printing device 1 includes a device body 2, defined by a case 5. A printhead unit 10 is mounted within case 5 along with an ink cartridge 3. Ink cartridge 3 is filled with three color inks I. A tape cartridge 4 containing a tape T is detachably attached to case 5. A keyboard 6 including various keys 6*a* is arranged on the front upper surface of device case 5. An LCD (not shown) is arranged on the rear upper surface of device body 2.

A selectively openable first door 8 is disposed on the rear side of device case 5 so that it closes a tape cartridge setting portion 7 in which tape cartridge 4 is set. First door 8 is opened to provide access for removing tape cartridge 4 from tape cartridge setting portion 7. A tape exit port 9 is disposed on the rear side of device case 5 at a location above first door 8. Printed tape T is discharged through tape exit port 9. A second door 11 is provided on the lower side of device case 5 adjacent printhead unit 10. Second door 11 is selectively openable so that ink cartridge 3 may be inserted into or removed from tape printing device 1.

An information processor unit (not shown) is disposed in the front portion of device case 5. The center portion of device case 5 contains printhead unit 10. An ink cartridge 3 is removeably attached to printhead unit 10. A head driver unit 12, mounted within case 5, is coupled to printhead unit 10 for driving printhead unit 10 (for scanning) when the printing is performed. The rear portion of device case 5 contains a tape supplying unit 13 for withdrawing tape T from tape cartridge 4 and supplying it to printhead unit 10 and a tape exit portion 14 for feeding printed tape T to the tape exit port 9. Printhead unit 10, head driver unit 12, tape supplying unit 13 are formed as a unitary structure, mounted on a base frame 14 and placed into device body 2.

During operation the desired information is entered into printing device 1 using a plurality of keys 6*a*. The user then ascertains that the entered information is correct and a print command is issued to printing device 1. In response, tape supplying unit 13 withdraws tape T from tape cartridge 4 and supplies it to printhead unit 10. Then, tape T passes in front of printhead unit 10 and head driver unit 12 reciprocally moves printhead unit 10 along tape T. During this reciprocate motion, printhead unit 10 receives ink 5 from ink cartridge 3 and ejects inks I onto moving tape T thereby printing on tape T. The movement of printhead unit 10 along tape T is a fast scan direction, and the direction of the movement of tape T through case body 5 is a slow scan direction. After printing is completed, tape T is cut and discharged out of tape printing device 1 through tape exit port 9 and used as a label.

Figure 2:
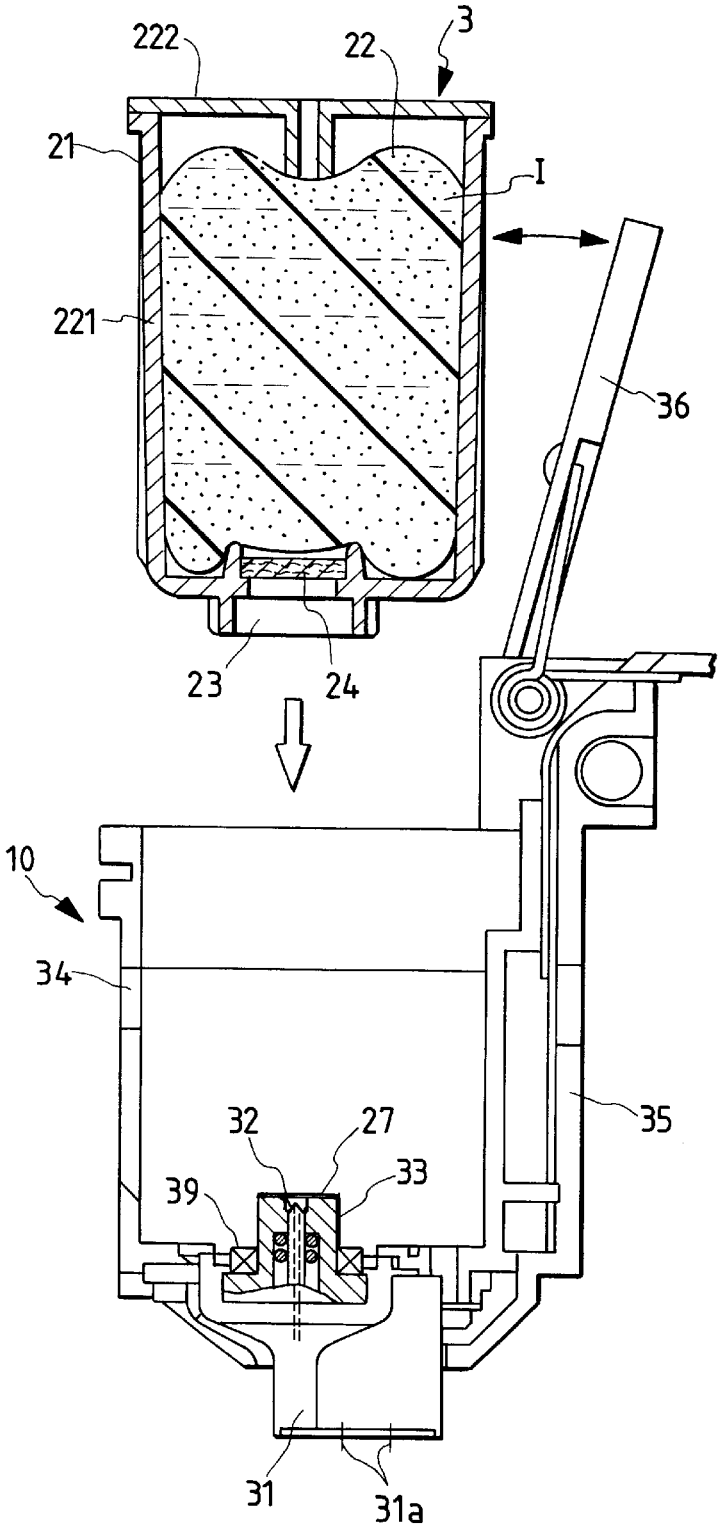
FIG. 2 is an exploded view of a printhead unit and an ink cartridge used in the tape printing device of FIG. 1 showing surface contact construction.
Figure 2A:
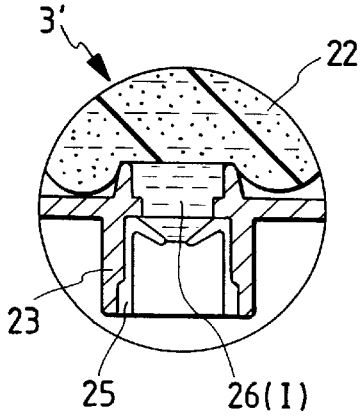
Figure 2B:
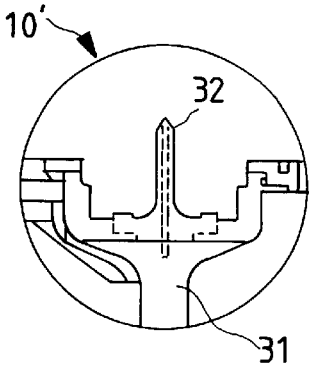

As shown in FIG. 2, there are two types of connection structures that connect a printhead unit to an ink cartridge: a surface contact type using ink cartridge 3 and printhead unit 10 (FIG. 2), and a needle connection type which employs ink cartridge 3' and printhead unit 10' (FIGS. 2(*a*), 2(*b*)). The surface contact type will first be described in detail, and afterwards the needle connection type will then be described highlighting the structural differences between the two.

Referring now to FIG. 2, there is shown ink cartridge 3 of the surface contact type formed with a cartridge case 21 which includes a case body 221 and a case cover 222 for covering the opened end of case body 221. Cartridge case 21, which is also called an ink tank, contains an ink holding member 22 for holding ink I. The ink tank includes three ink chambers (not shown) for containing inks I of three colors: cyan, magenta and yellow. An ink supplying port 23 for supplying ink I to printhead 10 is disposed at the bottom of case body 221 in a downwardly protruding direction. Ink cartridge 3 is detachably coupled to printhead unit 10 at ink supplying port 23. A filter 24 is placed below ink holding member 22.

Printhead unit 10 of the surface contact type includes a printhead 31 with a plurality of nozzles 31 a arrayed on its top face. A head needle 32 located within tape printing device 1 is formed on printhead 31. A connection cap 33 (connection member) for covering head needle 32 receives head needle 32 therein. A cartridge holder 34 receives ink tank cartridge 21. Printhead unit 10 is then mounted on a carriage 35, which is coupled with head driver unit 12. After ink cartridge 3 is attached to cartridge holder 34 a press cover 36 presses ink cartridge 3 against printhead 31.

Figure 3:
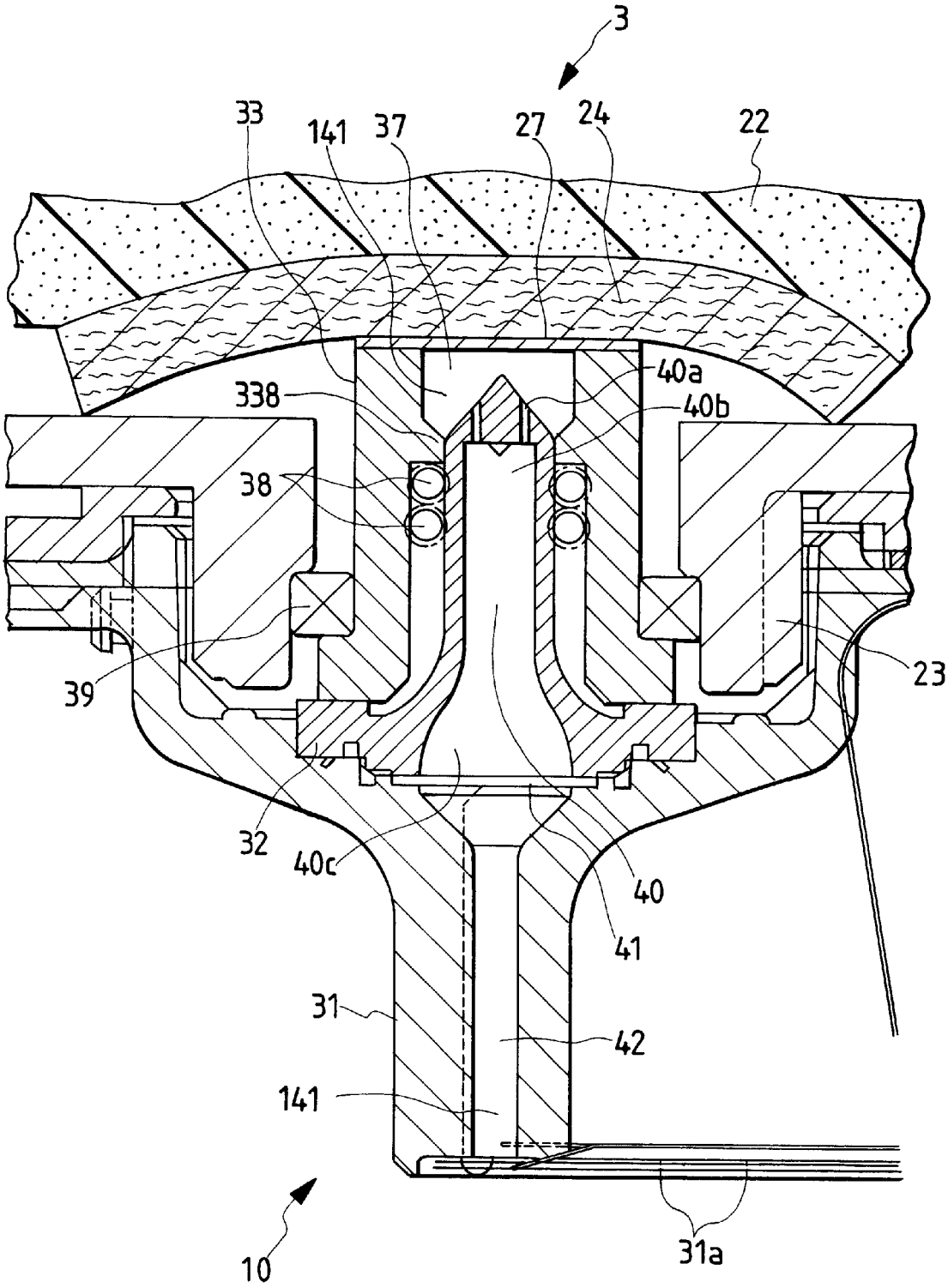
FIG. 3 is an enlarged cross sectional view of a printhead unit and ink cartridge of the surface contact type constructed in accordance to the present invention.

Referring now to FIG. 3, there is shown an enlarged connection cap 33 which is cylindrically shaped. A first ink passage 37 is formed between filter 24 and head needle 32, i.e. in close proximity to ink cartridge 3 within connection cap 33. The tip of head needle 32 protrudes into first ink passage 37. A pair of rings 38 are disposed within connection cap 33 and form a tension fit with head needle 32 adjacent a narrowed portion 338 of connection cap 33 which defines the bottom of first ink passage 37. Narrowed portion 338 of connection cap 33 and head needle 32 seal first ink passage 37. A seal ring 39 is disposed between the outer circumferential surface of connection cap 33 and the inner circumferential surface of ink supplying port 23 of ink cartridge 3.

Head needle 32 is dimensioned and shaped like an inverse T having a flattened base and a thinned rod with a wedge-like tip, which extends upwardly from a central part of the flattened base. A second ink passage 40 is formed within head needle 32 and includes a pair of thin passages 40*a* disposed at the upper end of second ink passage 40 and extending through the tip of head needle 32 and into first ink passage 37, a main passage 40*b* that extends from the lower ends of thin passages 40*a* to a reservoir 40*c* disposed at the base of head needle 32. Reservoir 40*c* is flared in a downstream direction from the direction of ink flow. A filter 41, which is disposed on head needle 32 thereby closing the bottom of reservoir 40*c*.

Printhead 31 includes a third ink passage 42 the upper end of which is in fluid communication with second ink passage 40, while the lower end of third ink passage 42 is branched into a plurality of thin passages. The distal ends of the branched thin passages are in fluid communication with nozzles 31*a*. First ink passage 37, second ink passage 40 and third ink passage 42 form a continuous ink passage 141 through printhead unit 10. The ink passage is formed in each of the three ink chambers of the ink tank under discussion, as a matter of course.

Ink cartridge 3' and printhead unit 10' of the needle connection type will be described with reference to FIGS. 2(*a*), 2(*b*) and 4. A rubber seal 25 is disposed within the inner side of ink supplying port 23. When ink cartridge 3' is attached to printhead unit 10' (FIG. 2(*b*)), head needle 32 is thrust through rubber seal 25 (FIG. 4) so that an ink reservoir 26 in ink cartridge 3' is in fluid communication with fourth ink passage 43 in printhead unit 10'.

Figure 4:
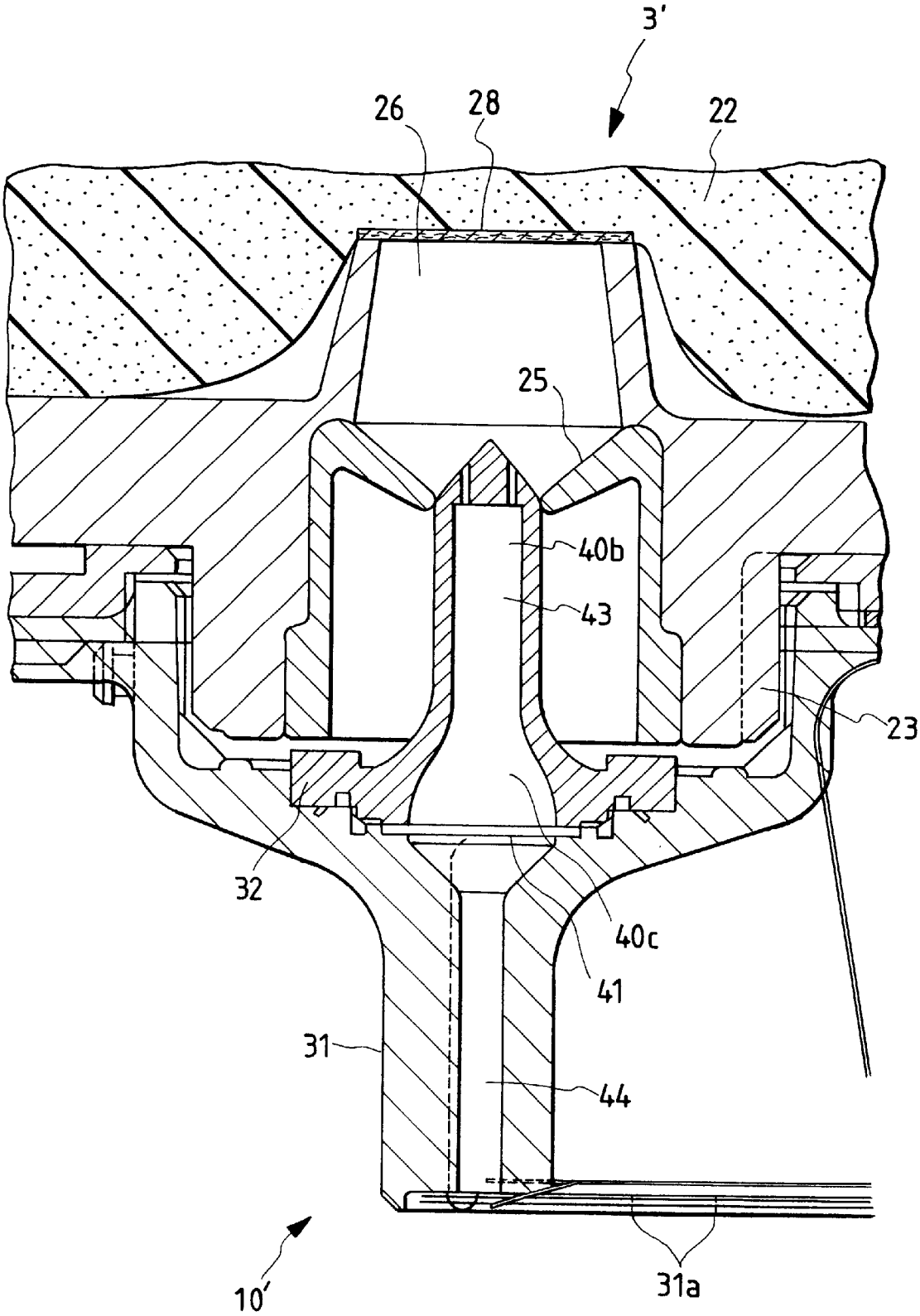
FIG. 4 is an enlarged cross sectional view of a printhead unit and an ink cartridge of the needle connection type constructed in accordance to the present invention.

As shown in FIG. 4, printhead unit 10' includes printhead 31 with nozzles 31 a arrayed on its tip. A head needle 32 is disposed on printhead 31 and printhead 31 is mounted on cartridge holder 34. Unlike printhead unit 10, connection cap 33 is not included in printhead unit 10'. Similar to printhead unit 10 of the surface contact type, a fourth ink passage 43 is formed in head needle 32, and a fifth ink passage 44 is formed in printhead 31. A filter 28 is provided in the ink cartridge 3'.

Referring now to FIGS. 5–21, there is shown a damper member 16 constructed in accordance with the present invention. In each of the embodiments discussed herein, damper member 16 absorbs a pulsation of ink I that results when tape printing device 1 receives an impact. Damper member 16 is located facing ink passage 37 or ink reservoir 26. As explained below, damper member 16 may be formed in a variety of ways and disposed in various locations within the printhead unit ink passage.

Figure 5:
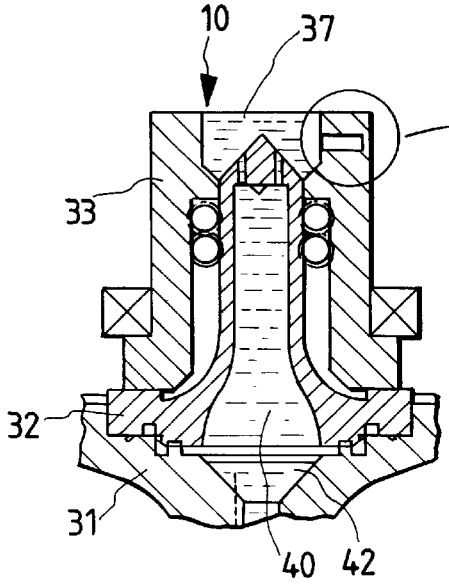
FIG. 5 is a cross sectional view of a printhead unit of the surface contact type constructed in accordance to the present invention.
Figure 5A:
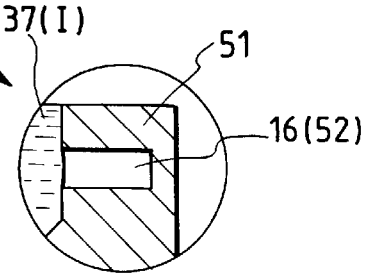

Referring now to FIGS. 5, 5(*a*), a damper member 16 is formed in circumferential wall 51 of connection cap 33 of printhead unit 10 of the surface contact type. Damper member 16 includes a stagnate air recess 52 which opens into first ink passage 37 and allows air to stagnate therein. To form stagnate air recess 52, a hole may be bored in the inner side of circumferential wall 51 by means of a small diameter drill. When first ink passage 37 is filled with ink I, air is sealed in stagnate air recess 52.

Stagnate air recess 52 is dimensioned and shaped as a long and narrow indentation. The surface tension of ink I prevents air from going into and out of stagnate air recess 52. The magnitude of the pulsation of ink I that results from an impact to tape printing device 1 is determined by the magnitude of the impact and the quantity of ink I in ink passage 37. If the magnitude of the pulsation of ink I is such that ink I is not sufficiently absorbed by a simple stagnate air recess, a plurality of stagnate air recesses 52 may be formed.

Figure 22:
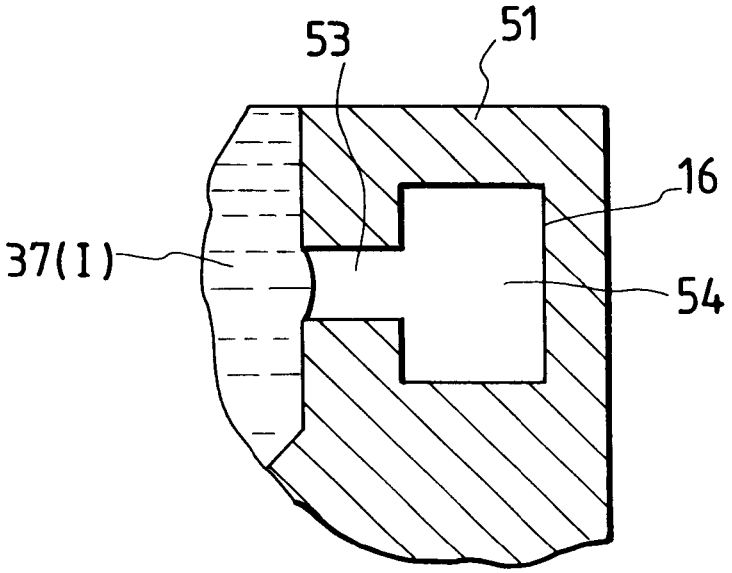
FIG. 22 is a cross sectional view of a damper member constructed in accordance with another embodiment of the present invention.

Damper member 16 may be modified as shown in FIG. 22. In this embodiment, damper member 16 includes a choke passage 53 in fluid communication with first ink passage 37 and a buffering space 54 which extends from choke passage 53 further into circumferential wall 51. When ink passage 37 is filled with ink I, air is sealed in buffering space 54. The volume of buffering space 54 for absorbing the ink pulsation may be increased while blocking an inflow of ink I into the buffering space 54.

Figure 23:
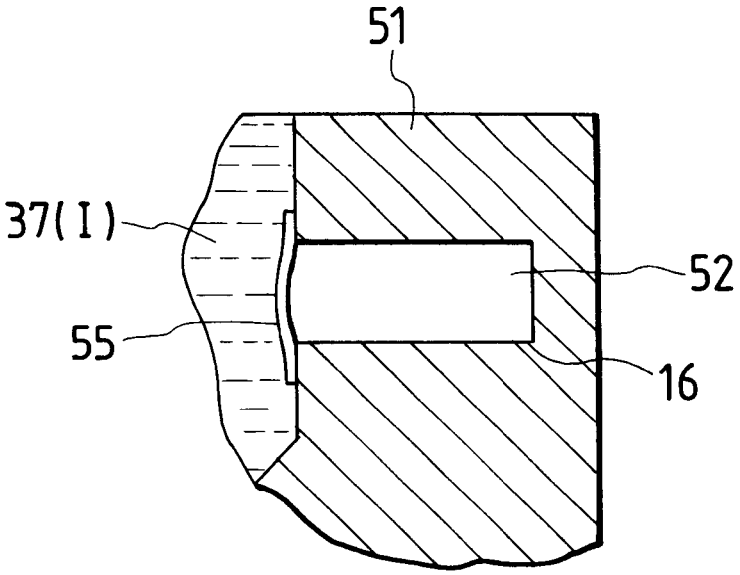
FIG. 23 is a cross sectional view of a damper member constructed in accordance with another embodiment of the present invention.

A second embodiment of damper member 16 is shown in FIG. 23. In this embodiment, a flexible film 55 is provided at the open end of stagnate air recess 52, i.e. the end that is adjacent to first ink passage 37, so that the flow of air into and out of stagnate air recess 52 is more reliably blocked.

Figure 24:
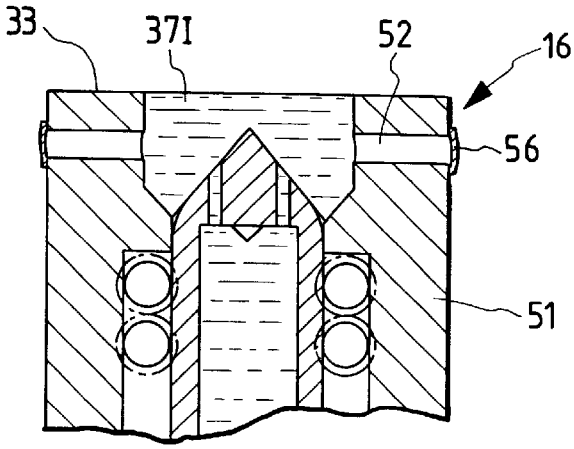
FIG. 24 is a cross sectional view of a damper member constructed in accordance with another embodiment of the present invention.
Figure 25:
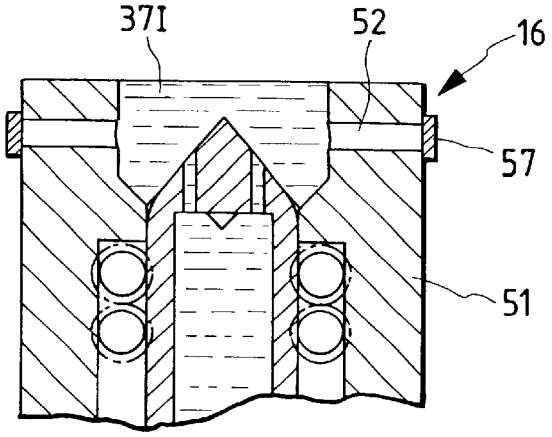
FIG. 25 is a cross sectional view of a damper member constructed in accordance with another embodiment of the present invention.
Figure 26:
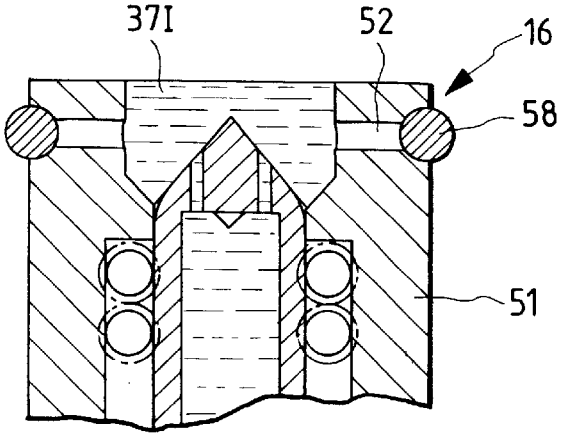
FIG. 26 is a cross sectional view of a damper member constructed in accordance with another embodiment of the present invention.

Because stagnate air recess 52 and buffering space 54 are formed in the inner side of circumferential wall 51, construction of damper member 16 according to the previous embodiments is difficult. Another embodiment of damper member 16 as shown in FIG. 24 overcomes this problem. In this embodiment, stagnate air recess 52 is formed in connection cap 33 by drilling through-holes from the outer side of connection cap 33 to first ink passage 37. The ends of the through-holes which open to the outside of cartridge holder 4, are sealingly closed with a sealing member, such as a film 56 (FIG. 24) welded on connection cap 33, a rubber hosepipe 57 (FIG. 25) connected to connection cap 33, or an O-ring 58 (FIG. 26).

Figure 6:
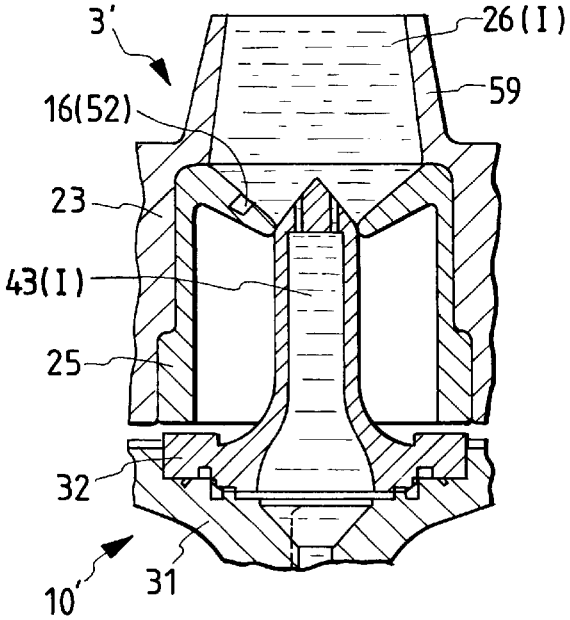
FIG. 6 is a cross sectional view of a printhead unit and ink cartridge of the needle connection type constructed in accordance with another embodiment of the present invention.

Another embodiment of damper member 16 is shown in FIG. 6 where damper member 16 is formed in the ink cartridge 3' of the needle connection type. In this embodiment, damper member 16 is formed in rubber seal 25. Damper member 16 includes a stagnate air recess 52 formed in rubber seal 25 which opens into ink reservoir 26. Because rubber seal 25 is a component that is formed separately from cartridge case 21, it is easy to form damper member 16 in rubber seal 25 before rubber seal 25 is attached to cartridge case 21.

Figure 7:
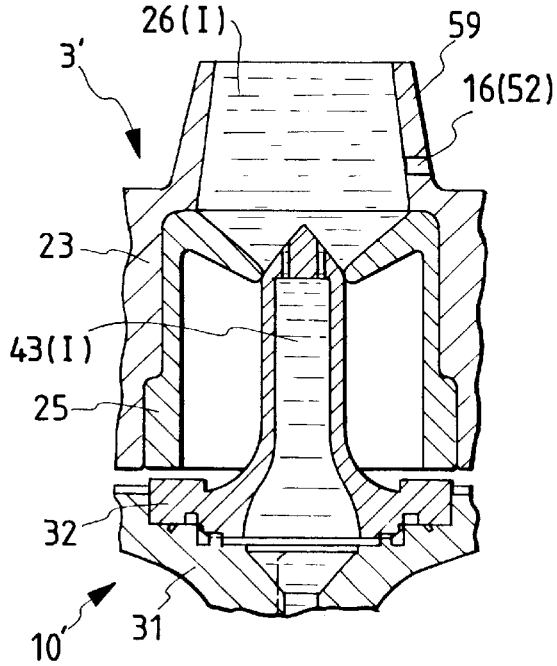
FIG. 7 is an alternative embodiment of the printhead unit and ink cartridge of the needle connection type constructed in accordance with another embodiment of the present invention.

Yet another embodiment of damper member 16 formed in ink cartridge 3' of the needle connection type is shown in FIG. 7. In this embodiment, damper member 16 is a stagnate air recess 52 formed in circumferential wall 59 of ink supplying port 23 which opens into ink reservoir 26.

Figure 8:
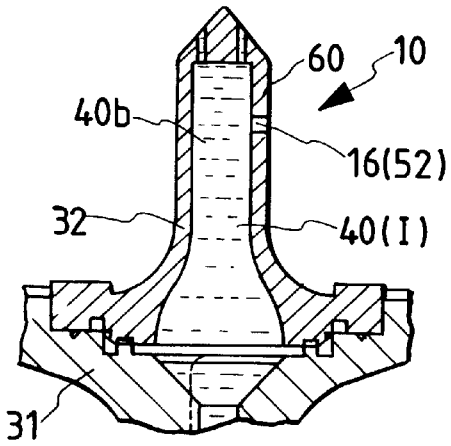
FIG. 8 is a sectional view of the printhead unit constructed in accordance with an alternative embodiment of the present invention.

Still another embodiment of damper member 16 is shown in FIG. 8. Damper member 16 includes a stagnate air recess 52 formed in head needle 32 of printhead unit 10 of the surface contact type or printhead unit 10' of the needle connection type. In this embodiment, damper member 16 is formed in the main body 60 of head needle 32. Damper member 16 includes an stagnate air recess 52 opened into second ink passage 40 in the case of printhead unit of the surface contact type or fourth ink passage 43 in the case of printhead unit 10' of the needle connection type.

Figure 9:
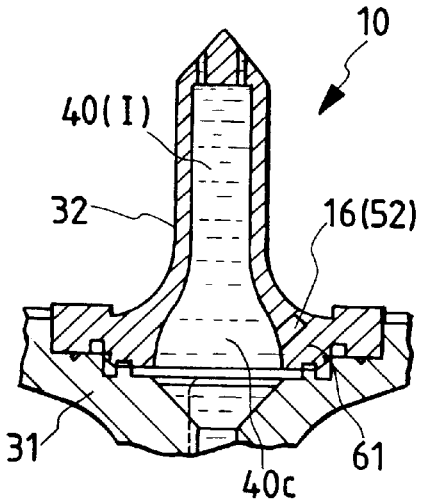
FIG. 9 is a sectional view of the printhead unit constructed in accordance with another embodiment of the present invention.
Figure 10:
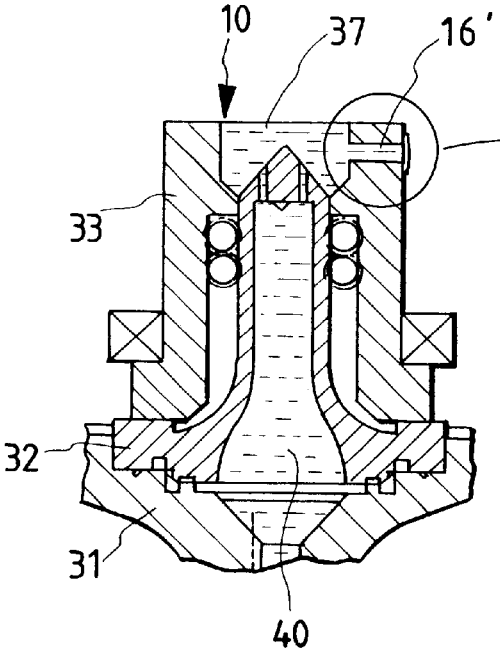
FIG. 10 is a sectional view of a printhead unit of the surface connection type constructed in accordance with the present invention.
Figure 10A:
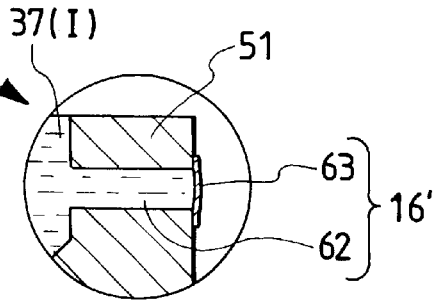

As shown in FIG. 9 damper member 16 includes a recess 52. Recess 52 is formed in the base 61 of head needle 32 of the printhead unit 10 of the surface contact type or printhead unit 10' of the needle connection type. Recess 52 opens into either second ink passage 40 (surface connection type) or fourth ink passage 43 (needle connection type). Because head needle 32 is used for both the surface contact type and the needle connection type printhead units, by placing damper member 16 in head needle 32 the damping function can be easily incorporated into either of the printhead connection structure types.

Reference is now made to FIGS. 10–14 which illustrate a damper member constructed in accordance with another embodiment, the primary difference being that the recess fills with ink. Second damper member 16' includes a passage 62. Passage 62 is formed in circumferential wall 51 of connection cap 33 of printhead unit 10 of the surface contact type. Passage 62 connects first ink passage 37 to the outside of the connection cape 33. One end of passage 62, the end on the outer circumference of connecting cap 33, is sealed with a flexible sealing film 63. When pulsation of ink I enters passage 62, first ink passage 37 is opened to the air through flexible sealing film 63 which absorbs most of the pulsation of ink I.

Figure 27:
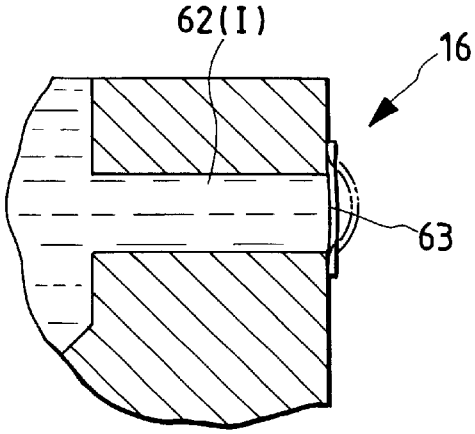
FIG. 27 is a cross sectional view of a damper member constructed in accordance with another embodiment of the present invention.
Figure 28:
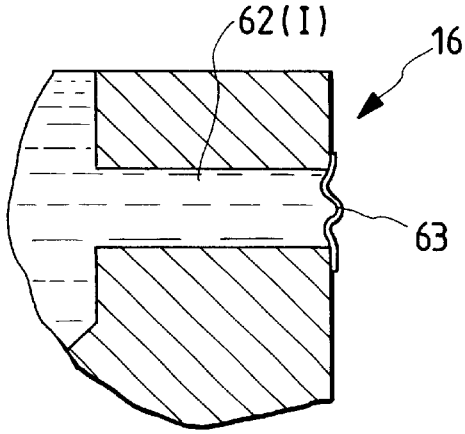
FIG. 28 is a cross sectional view of a damper member constructed in accordance with another embodiment of the present invention.
Figure 29:
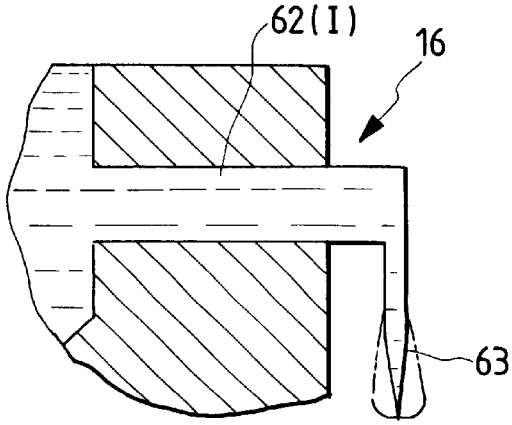
FIG. 29 is a cross sectional view of a damper member constructed in accordance with another embodiment of the present invention.

Other embodiments of second damper member 16' are shown in FIGS. 27–29. In FIG. 27, sealing film 63 expands when it receives a pressure from ink I pulsating through passage 62. In FIG. 28, sealing film 63 is previously slackened so it can expand further under pressure. In yet another embodiment shown in FIG. 29, the tip of sealing film 63 is formed to be balloon-shaped.

Figure 11:
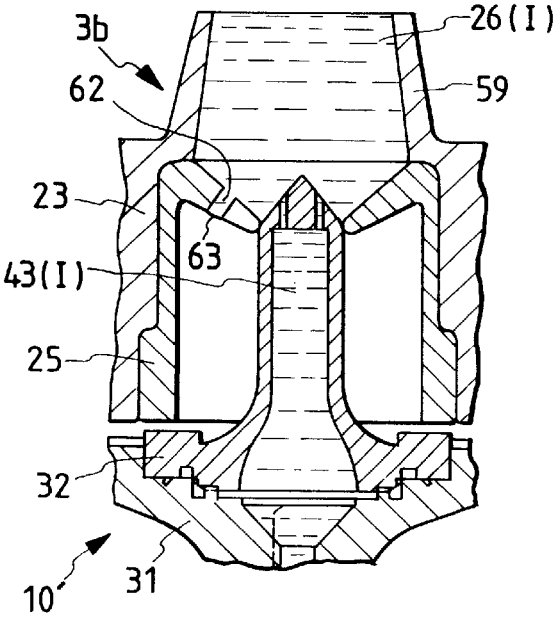
FIG. 11 is a sectional view of the printhead unit and ink cartridge of the needle connection type constructed in accordance with another embodiment of the present invention.

Another embodiment damper member 16' is shown in FIG. 11 where second damper member 16' is formed in ink cartridge 3' of the needle connection type. Specifically, second damper member 16' includes a passage 62 formed through a portion of rubber seal 25 so that one end of second passage 62 opens into ink reservoir 26 while the other end opens into the inner part of rubber seal 25. The end of passage 62 away from ink reservoir 37 is also covered with a sealing film 63.

Figure 12:
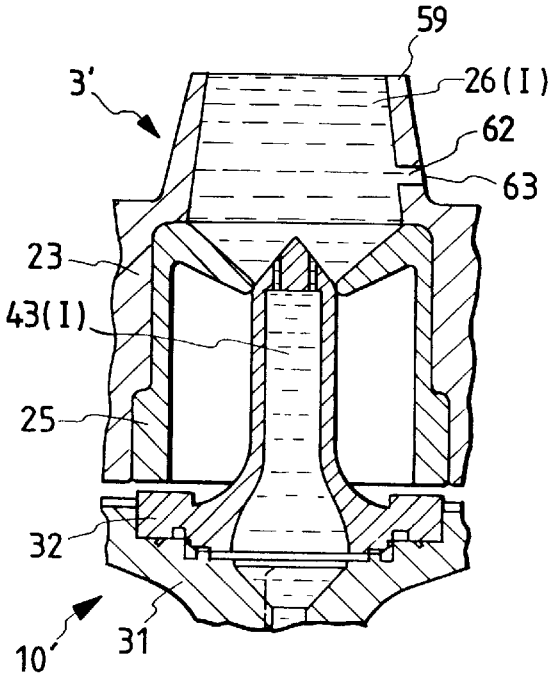
FIG. 12 is a cross sectional view of the printhead unit and ink cartridge constructed in accordance with another embodiment of the present invention.

Yet another embodiment of second damper member 16' is shown in FIG. 12. In this embodiment, damper member 16' is also formed in the ink cartridge 3' of the needle connection type. Specifically, damper member 16' includes a through-hole passage 62 passing through circumferential wall 59 of ink supplying port 23. A sealing film 63 is disposed on the outer surface of circumferential wall 59 across passage 62.

Figure 13:
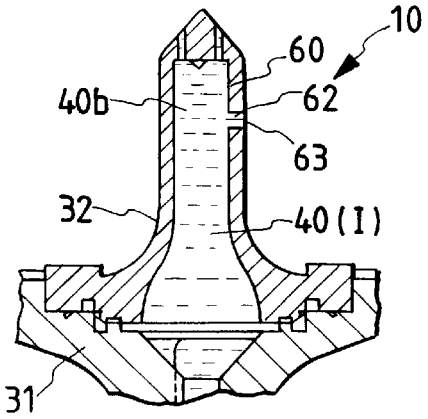
FIG. 13 is a sectional view of the printhead unit constructed in accordance with another embodiment of the present invention.

Still another embodiment of damper member 16' is shown in FIG. 13. In this embodiment damper member 16' includes a passage 62 which passes through the main body of head needle 32 (of either the needle connection type or the surface contact type). One end of the passage is opened into second ink passage 40 (surface connection type) or fourth ink passage 43 (needle connection type). The opposite end is covered with a sealing member 63.

Figure 14:
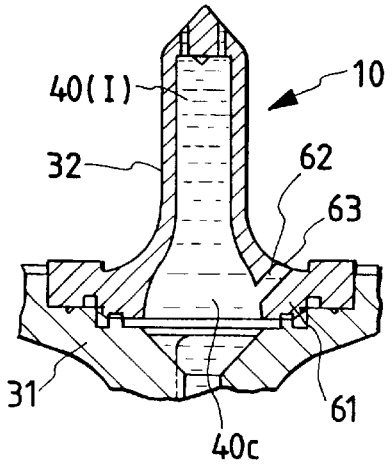
FIG. 14 is a sectional view of the printhead unit constructed in accordance with another embodiment of the present invention.

A further embodiment damper member 16' is shown in FIG. 14. In this embodiment damper member 16' includes a through-hole passage 62 extending through base 61 of head needle 32. One end of the passage 62 is opened into either second ink passage 40 (surface connection type) or fourth ink passage 43 (needle connection type). The opposite end of passage 62 is covered by film 63 as discussed above.

Figure 30:
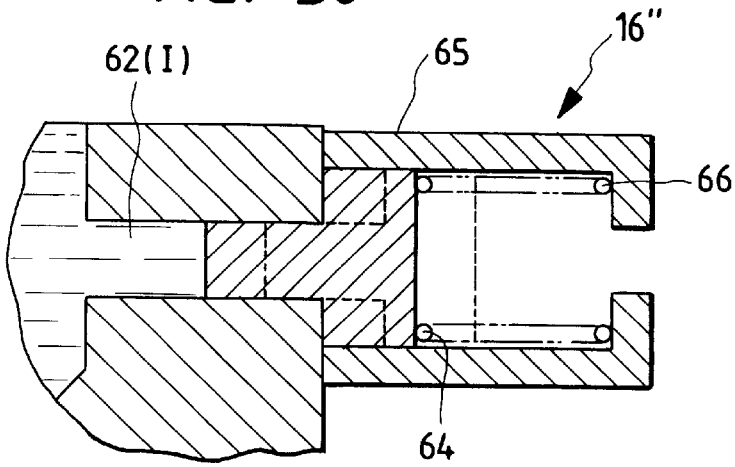
FIG. 30 is a cross sectional view of a damper member constructed in accordance with another embodiment of the present invention.
Figure 31:
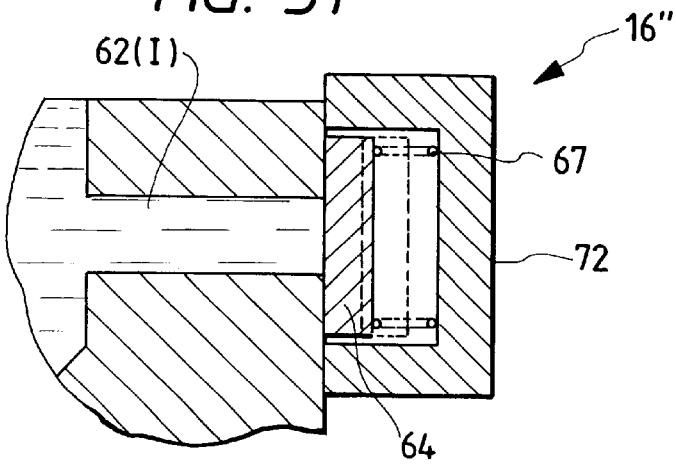
FIG. 31 is a cross sectional view of another alternative embodiment of a damper member constructed in accordance with another embodiment of the present invention.
Figure 32:
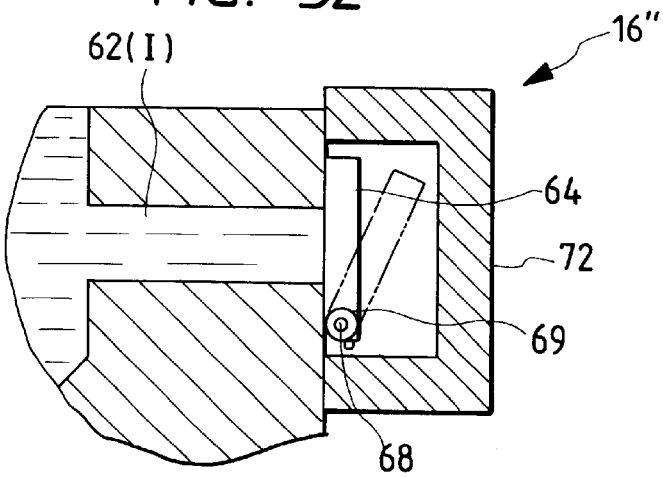
FIG. 32 is an enlarged cross sectional view of another embodiment of a damper member constructed in accordance to the present invention.

Reference is made to FIGS. 30–32 in which another embodiment of the damper generally indicated as 16" is shown. These embodiments differ from damper member 16' in that a sealing cap is used in place of sealing film 63 to tightly seal the end of the passage that is opened to the outside. Specifically referring to FIG. 30, damper member 16" includes cylindrical member 65 mounted on circumferential wall 51 across a passage 62. A sealing cap 64 is T-shaped with the cross bar of T-shaped sealing cap 64 slidably movable in cylindrical member 65. The vertical portion of T-shaped sealing cap 64 is slidably received in passage 62 so that its tip reaches approximately the mid point of passage 62. A coil spring 66 is disposed within cylindrical member 65 to bias sealing cap 64 into passage 62. Usually when ink I is consumed, a negative pressure is created within passage 62 so that the vertical portion sealing cap 64 moves into passage 62 without the aid of a coiled spring 66. To secure the reliable insertion of sealing cap 64, coiled spring 66 can be used to constantly urge sealing cap 64 towards passage 62. When ink I is pulsated thereby applying pressure to sealing cap 64, sealing cap 64 undergoes a piston-like motion; moving against the urging force of spring 66 while a portion of the vertical bar portion remains within the passage 62. Thus, the pulsation of ink I is absorbed through the motion of sealing cap 64.

In another embodiment shown in FIG. 31, a damper member 16" includes a passage 62 extending through circumferential wall 59. A housing 72 mounted on circumferential wall 59 extends across an opening passage 62. A sealing cap 64 slidably mounted within housing 72 is pressed against the opening of passage 62 thus sealing passage 62. In yet another embodiment shown in FIG. 32, sealing cap 64 is pivotably mounted about a support shaft 68 within housing 72. A torsion coiled spring 69 is mounted about shaft 68. Sealing cap 64 pivots to open and close the opening of passage 62 and is urged in the sealing direction by torsion coiled spring 69. In damper member 16" of FIGS. 31 and 32, ink I may leak out of passage 62. To absorb the leaked ink I, sealing cap 64 may be covered with suitable ink absorbing means.

Figure 15:
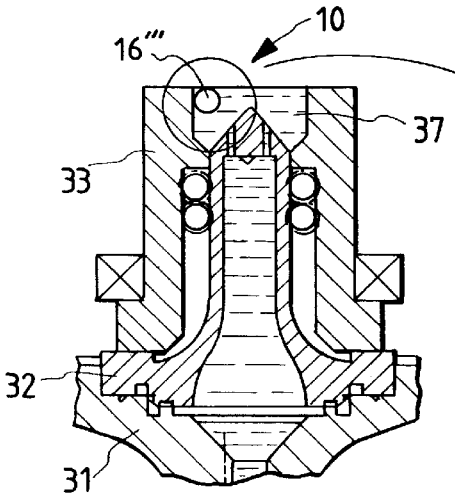
FIG. 15 is a sectional view of a printhead unit of the surface connection type constructed in accordance with another embodiment of the present invention.
Figure 15A:
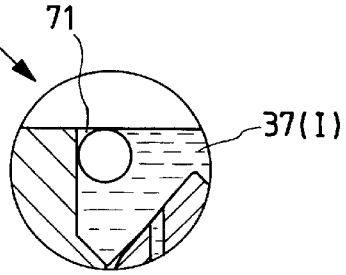
Figure 16:
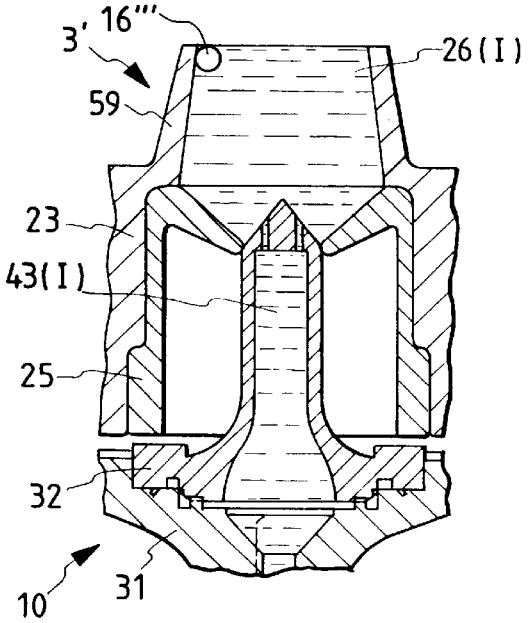
FIG. 16 a cross sectional view of a printhead unit and ink cartridge constructed in accordance with another embodiment of the present invention.
Figure 17:
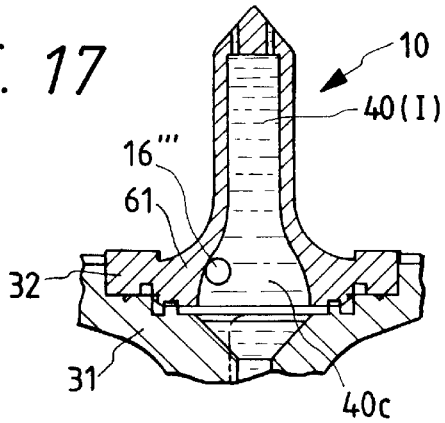
FIG. 17 is a cross sectional view of a printhead unit constructed in accordance with another embodiment of the present invention.

Reference is now made to FIGS. 15–17 in which another embodiment of the damper member, generally indicated as 16''' is shown. As shown in FIGS. 15, 15(*a*) damper member 16''' is formed in connection cap 33 of printhead unit 10 (the surface contact type) and consists of a flexible film member 71 filled with a gas, for example, air. Film member 71 is bonded onto the inner wall of first ink passage 37. When a pressure caused by the pulsation of ink I acts on film member 71, film member 71 contracts to absorb the pressure. Because this does not require any modification to connection cap 33, construction of damper member 16''' according to this embodiment is greatly simplified. Another embodiment of damper member 16''', shown in FIG. 16, is formed in ink cartridge 3' of the needle connection type. In this embodiment film member 71 is bonded onto the inner wall of ink reservoir 26. In yet another embodiment shown in FIG. 17, damper member 16''' includes film member 71 bonded in head needle 32 of printhead unit 10 (the surface contact type) of printhead unit 10' (the needle connection type). In this embodiment, damper member 16''' consists of film member 71 which is bonded on the inner wall of reservoir 40*c*.

Figure 18:
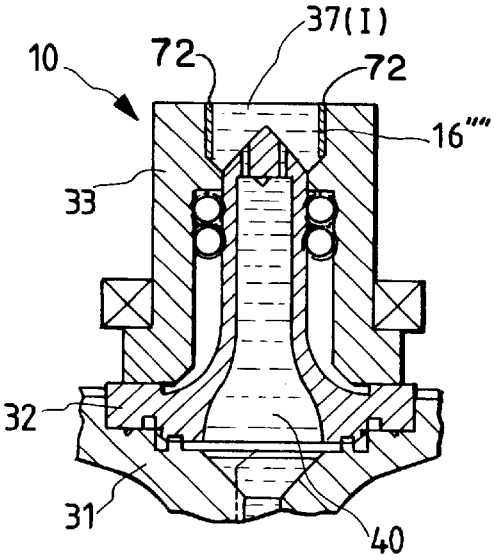
FIG. 18 is a cross sectional view of printhead unit of the surface connection type constructed in accordance with another embodiment of the present invention.

Reference is now made to FIGS. 18–21 in which another embodiment of the damper member, generally indicated as 16''', is shown. The difference between damper member 16''' and damper member 16''' is the use of a foam member. Referring now to FIG. 18, damper member 16''' consists of a ring-shaped foam member 72 formed on connection cap 33 of printhead unit 10 of the surface contact type. Foam member 72 is dimensioned and shaped to be disposed on the inner wall of first ink passage 37. Foam member 72 includes a plurality of pores. When the pulsation of ink I exerts pressure on foam member 72, the pores of foam member 72 are compressed thereby absorbing the pressure. Because no modification of connection cap 33 is required for damper member 16''' in this embodiment, construction is greatly simplified.

Figure 19:
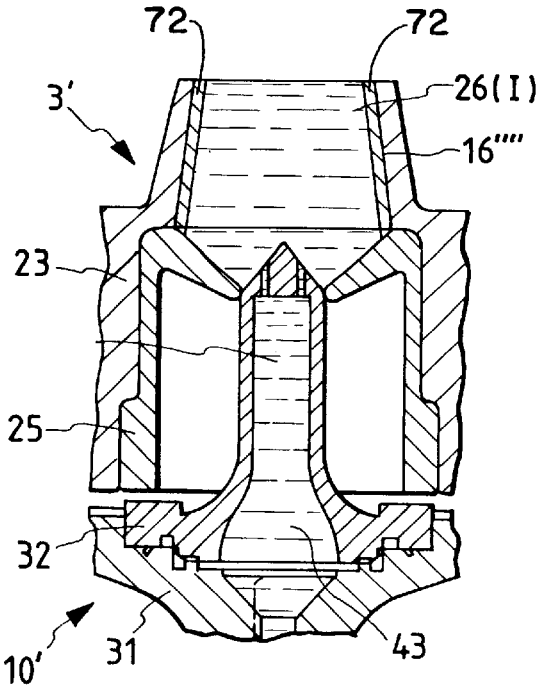
FIG. 19 is a cross sectional view of a printhead unit and an ink cartridge constructed in accordance with another embodiment of the present invention.
Figure 20:
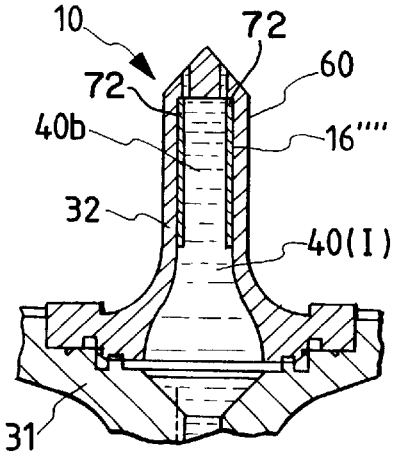
FIG. 20 is a cross sectional view of a printhead unit constructed in accordance with another embodiment of the present invention.
Figure 21:
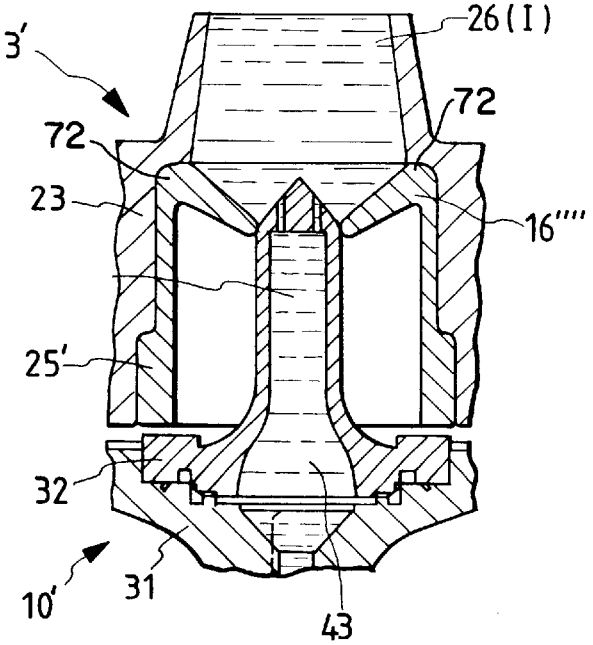
FIG. 21 a cross sectional view of a printhead unit and ink jet cartridge of the needle connection type constructed in accordance with another embodiment of the present invention.

Another embodiment of damper member 16''', shown in FIG. 19 is provided in ink cartridge 3' of the needle connection type. In this embodiment foam member 72 is disposed on the inner wall of ink reservoir 26. Yet another embodiment of damper member 16''', shown in FIG. 20, includes foam member 72 disposed in head needle 32 of the printhead unit 10 (the surface contact type) or printhead unit 10' (the needle connection type). Specifically, foam member 72 is disposed on the inner wall of main passage 40*b*. In another embodiment, shown in FIG. 21, damper member 16''' is provided in ink cartridge 3' of the needle connection type. Damper member consists of a rubber seal 25' formed from foam. Foam member 72 need only be on the portion of rubber seal 25' that faces ink reservoir 26. When a pressure caused by ink pulsation is exerted on foam member 72, the pores of foam member 72 are compressed to absorb the pressure.

As described above, the present invention provides damper member 16 in printhead unit 10 or ink cartridge 3, that properly absorbs a pulsation of ink I caused by impact to tape printing device 1. Therefore, if tape printing device 1 receives an impact, the meniscuses in the nozzle plane are not destroyed, thus greatly improving tape printing device 1 impact resistance.

Damper member 16 may be provided in printhead unit 10 or ink cartridge 3. However, in the surface contact type of printhead where ink I is stagnated in ink cartridge 3, the damper member 16 is preferably provided in connection cap 33 of printhead unit so that head needle 32 and the printhead 31 may be used without any design modifications and damper member 16 operation is simplified. On the other hand, in order to improve the impact resistance of tape printing device 1.

While the present invention was described in reference to the tape printing device 1, it is evident that the invention is applicable to ink jet printers in general.

As seen from the foregoing description, a printhead unit constructed according to the present invention absorbs a pulsation of the ink caused by an impact applied to a printing device before the pulsating ink propagates to the nozzle plane and breaks the meniscuses. In this way the meniscuses in the nozzle plane are protected from breakage and the impact resistance of the printing device is greatly improved.

Likewise, in an ink jet printer constructed according to the present invention, the impact resistance of its printhead unit is greatly improved. In this way, the ink jet printer can be made portable or otherwise frequently moved and still avoid the adverse consequences of broken meniscuses.

In an ink cartridge constructed according to the present invention, where damper member 16 properly absorbs a pulsation of ink, merely attaching the ink cartridge to the printer improves the printer's impact resistance without any design modifications.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

What is claimed is:

1. A printhead unit detachably coupled to an ink cartridge, comprising:

an ink passage; and damper means disposed facing said ink passage for absorbing a pulsation of ink in said ink passage caused by impact to the ink cartridge when the ink cartridge is moved while the ink cartridge is coupled to the printhead unit.

2. The printhead unit of claim 1, wherein said ink cartridge includes an ink supply port and said printhead unit includes a printhead; a head needle mounted on said printhead; a connection member detachably coupled to said ink supply port for receiving said head needle; and said ink passage includes a first ink passage in fluid communication with said ink supplying port, a second ink passage in fluid communication with said first ink passage, and a third ink passage in fluid communication with said second ink passage.

3. The printhead unit of claim 2, wherein said damper means is provided in said connection member facing said first ink passage.

4. The printhead unit of claim 3, wherein said connection member has a circumferential wall, wherein said damper means includes a stagnate air recess having an opening at a first end and being closed at a second end for allowing air to stagnate therein, said stagnate air recess is disposed in said circumferential wall and in fluid communication with said first ink passage.

5. The printhead unit of claim 4, wherein said stagnate air recess includes a choke passage formed in said circumferential wall in fluid communication with said first ink passage, said choke passage dimensioned and shaped for blocking a flow of ink into said stagnate air recess, and a buffering space communicating with said choke passage, said buffering space dimensioned and shaped for absorbing the pulsation of ink and said choke passage being disposed between said buffering space and said first ink passage.

6. The printhead unit of claim 3, wherein said connection member has a circumferential wall, and said damper means includes a passage having a first opening in fluid communication with said first ink passage and a second opening on the outside of said circumferential wall, and a flexible sealing film member extending across said second opening for sealing said passage.

7. The printhead unit of claim 2, wherein said damper means is a flexible, film member containing a gas and positioned in said first ink passage.

8. The printhead unit of claim 2, wherein said damper means is a flexible, foam member disposed in said first ink passage.

9. The printhead of claim 1, wherein said ink cartridge includes an ink supply port and said printhead unit includes a printhead; a head needle mounted on said printhead; said head needle detachably coupled to said ink supply port; and said ink passage includes a first ink passage formed in said head needle and in fluid communication with said ink supply port, and a second ink passage being formed in said printhead and in fluid communication with said first ink passage.

10. The printhead unit of claim 1, wherein said printhead unit includes an ink jet printhead.

11. The ink cartridge of claim 10, wherein said printhead unit includes an ink supply port and an ink reservoir, and wherein said damper means for absorbing a pulsation of ink is positioned to face said ink reservoir.

12. The printhead unit of claim 11, wherein said ink supply port has a circumferential wall and said damper member is disposed in said circumferential wall.

13. The printhead unit of claim 11, further comprising a sealing member disposed in said ink supply port for sealing said ink reservoir, a head needle mounted on said printhead unit received by said sealing member, and said damper means being disposed in said sealing member.

14. The printhead unit of claim 11, further comprising a sealing member formed as a flexible foam member, said sealing member being disposed in said ink supply port for sealing said ink reservoir, and a head needle mounted on said printhead unit being received by said sealing member, and said damper means is said sealing member.

15. The printhead unit of claim 11, wherein said damper means is a flexible film member containing gas disposed in said ink reservoir.

16. The printhead unit of claim 11, wherein said damper meams is a flexible, foam member disposed in said ink reservoir.

17. A printhead unit detachably coupled to an ink cartridge, comprising:

an ink passage; and damper means disposed facing said ink passage for absorbing a pulsation of ink in said ink passage;

said ink cartridge having an ink supply port and said printhead unit having a printhead; a head needle mounted on said printhead; a connection member detachably coupled to said ink supply port for receiving said head needle; and said ink passage includes a first ink passage in fluid communication with said ink supplying port, a second ink passage in fluid communication with said first ink passage, and a third ink passage in fluid communication with said second ink passage;

said damper means being provided in said connection member facing said first ink passage; and said connection member having a circumferential wall, and said damper means including a stagnate air recess formed as a through-hole passing through said circumferential wall of said connection member, said through-hole having a first end and a second end, said stagnate air recess extending in a direction perpendicular to said first ink passage, and sealing means for sealing said first end and said second end of said through-hole.

18. A printhead unit detachably coupled to an ink cartridge, comprising:

an ink passage; and damper means facing said ink passage for absorbing a pulsation of ink in said ink passage;

said ink cartridge including an ink supply port and said printhead unit including a printhead; a head needle mounted on said printhead; a connection member detachably coupled to said ink supply port for receiving said head needle; and said ink passage includes a first ink passage in fluid communication with said ink supplying port a second ink passage in fluid communication with said first ink passage, and a third ink passage in fluid communication with said second ink passage;

said damper means being provided in said connection member facing said first ink passage; and said connection member having a circumferential wall, and said damper means including a stagnate air recess formed in said circumferential wall with an opening therein, said opening facing said ink passage, a flexible, sealing film member positioned across said opening, said sealing film member being positioned in between said first ink passage and said stagnate air recess.

19. A printhead unit detachably coupled to an ink cartridge, comprising:

an ink passage; and damper means facing said ink passage for absorbing a pulsation of ink in said ink passage;

said ink cartridge including an ink supply port and said printhead unit including a printhead; a head needle mounted on said printhead; a connection member detachably coupled to said ink supply port for receiving said head needle; and said ink passage including a first ink passage in fluid communication with said ink supplying port, a second ink passage in fluid communication with said first ink passage, and a third ink passage in fluid communication with said second ink passage;

said damper means being provided in said connection member facing said first ink passage; and said connection member having a circumferential wall having an outside, wherein said damper means includes a passage having a first opening in fluid communication with said first ink passage and a second opening on the outside of said circumferential wall, a housing mounted across said second opening; a sealing cap mounted in said housing for sealing said passage and moveable within said housing between a first direction towards said second opening and a second direction away from said second opening for absorbing said pulsation of ink, and urging means for urging said sealing cap in the first direction.

20. A printhead unit detachably coupled to an ink cartridge, comprising:

an ink passage; and damper means facing said ink passage for absorbing a pulsation of ink in said ink passage;

said ink cartridge including an ink supply port and said printhead unit including a printhead; a head needle mounted on said printhead; a connection member detachably coupled to said ink supply port for receiving said head needle; and said ink passage including a first ink passage in fluid communication with said ink supplying port, a second ink passage in fluid communication with said first ink passage, and a third ink passage in fluid communication with said second ink passage; and said damper means being mounted in said head needle and disposed to face said second ink passage.

21. A printhead unit detachably coupled to an ink cartridge, comprising:

an ink passage; and damper means facing said ink passage for absorbing a pulsation of ink in said ink passage;

said ink cartridge includes an ink supply port and said printhead unit includes a printhead; a head needle mounted on said printhead; said head needle detachably coupled to said ink supply port; and said ink passage includes a first ink passage formed in said head needle and in fluid communication with said ink supply port, and a second ink passage being formed in said printhead and in fluid communication with said first ink passage; and said damper means being mounted in said head needle and disposed to face said fourth ink passage.

* * * * *